United States Patent [19]

Ettehadieh

[11] Patent Number: 5,042,401

[45] Date of Patent: Aug. 27, 1991

[54] WATER COOLED ROLLING GRATE INCINERATOR

[75] Inventor: Bozorg Ettehadieh, Houston, Tex.

[73] Assignee: Westinghouse Electric Corp., Pittsburgh, Pa.

[21] Appl. No.: 532,821

[22] Filed: Jun. 4, 1990

[51] Int. Cl.[5] ..... F23K 3/18

[52] U.S. Cl. ..... 110/246; 110/275; 110/276

[58] Field of Search ..... 110/246, 275, 276

[56] References Cited

U.S. PATENT DOCUMENTS

| | | | |
|---|---|---|---|
| 3,808,989 | 5/1974 | Knaak | 110/246 |
| 4,610,209 | 9/1986 | Temelli | 110/276 |
| 4,699,070 | 10/1987 | O'Connor | 110/246 |
| 4,726,765 | 2/1988 | O'Connor | 110/246 |
| 4,735,157 | 4/1988 | Jurusz | 110/246 |
| 4,951,580 | 8/1990 | Samera, Jr. et al. | 110/289 |

*Primary Examiner*—Henry C. Yuen

*Attorney, Agent, or Firm*—Fred J. Baehr, Jr.

[57] ABSTRACT

A roller grate incinerator cooperatively associated with a waste heat boiler, wherein a plurality of cylindrical shaped water cooled roller grates are disposed on an incline to form a undulating water cooled surface upon which a bed waste is laid and burned as the roller grates turn moving the burning waste along the undulating surface, which has a plurality of perforations through which combustion air is supplied to the underside of the bed to facilitate burning of the waste and the flow of hot gases through the waste heat boiler.

10 Claims, 6 Drawing Sheets

WATER COOLED ROLLING GRATE INCINERATOR

BACKGROUND OF THE INVENTION

The invention relates to a municipal solid waste incinerator and more particularly to a water cooled rolling grate municipal solid waste incinerators.

Municipal solid waste incinerators having a water cooled rotary combustor have limiting waste processing capacity due primarily to the limited size of the rotary combustor. So that to handle very large processing capacities multiple incinerators must be utilized. The rotary water cooled combustor has the advantage of operating at lower metal temperatures and multiple smaller incinerators also have some operating and maintenance advantages over a single large unit. The manufacturing costs of multiple smaller units is normally much higher than the manufacturing cost of a single larger unit.

SUMMARY OF THE INVENTION

Among the objects of the invention may be noted the provision of a water cooled grate which can be scaled up to handle large amounts of waste in a single unit providing a cost effective design.

In general, a water cooled roller grate incinerator cooperatively associated with a boiler, when made in accordance with this invention, comprises, a plurality of roller grates, each having a plurality of circular arrays of spaced apart cooling tubes separated by perforated webs and connected at each end to a ring header to form cylindrical shaped roller grates. A rotary joint is associated with each cylindrical grate for supplying cooling fluid to the circular array of tubes to keep them cool and for returning heated fluid to the boiler Each roller grate is disposed to rotate about a centrally disposed axis. The axes of the roller grates are disposed in an inclined plane generally parallel to each other forming an undulating surface. A waste hopper with a ram disposed on the lower end of the hopper feeds waste to the undulating surface. A combustion air system supplies combustion through the perforated webs to the waste on the undulating surface. The grates rotate transferring the waste from one roller grate to the next lower roller grate allowing the waste to burn as it moves down the undulating surface.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
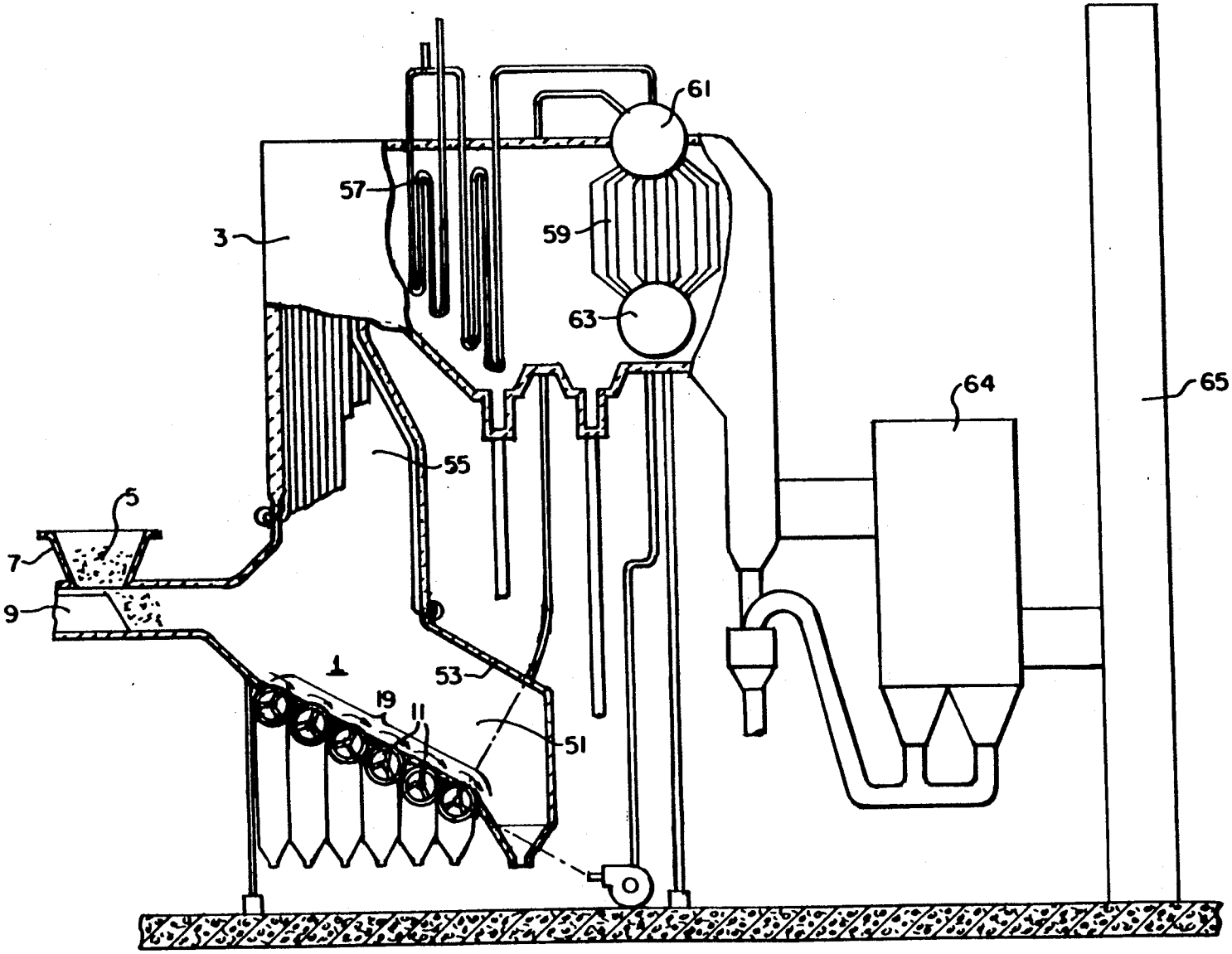
FIG. 1 is a sectional view of a roller grate incinerator.
Figure 2:
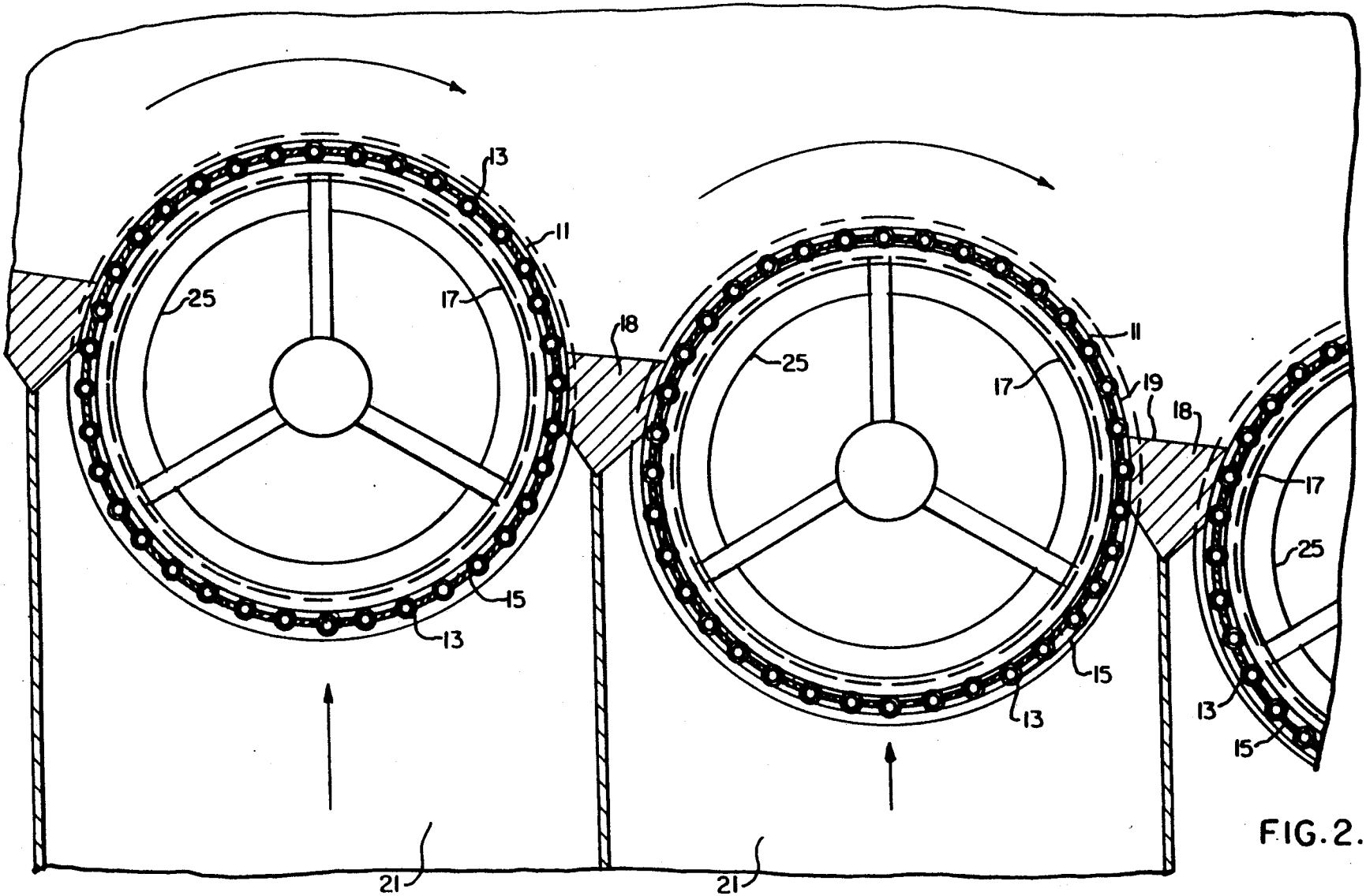
FIG. 2 is an enlarged partial sectional view of the roller grates.

Referring now to the drawings in detail and in particular to FIG. 1 there is shown a water cooler roller grate incinerator 1 including a waste heat boiler 3 for burning municipal solid waste 5 and making steam in the waste heat boiler portion 3. The waste 5 is fed into a waste hopper 7 and a feed ram 9 disposed at the lower end of the waste hopper 7 pushes the waste 5 into the incinerator 1, which comprises a plurality of cylindrical shaped roller grates 11 formed from a plurality of spaced apart cooling tubes or pipes 13 having a perforated web 15 disposed between adjacent pipes 13. The pipes 13 and interposed perforated webs 15 are disposed in a circular array. Each end of each pipe is connected to a ring header 17 to form the water cooled cylindrical shaped roller grates. The roller grates 11 are each disposed for rotation about a central axis. The roller grates 11 are placed adjacent each other in such a manner that their axes are parallel and are disposed in an inclined plane, which slopes downwardly as it extends away from the feed ram 9. A baffle 18 is disposed between the adjacent roller grates 11 to transfer the waste from one roller grate to the next lower roller grate 11 as they rotate about their axis. The roller grates 11 and baffles 18 cooperate to form an undulating surface 19 upon which the waste 5 is burned.

Figure 8:
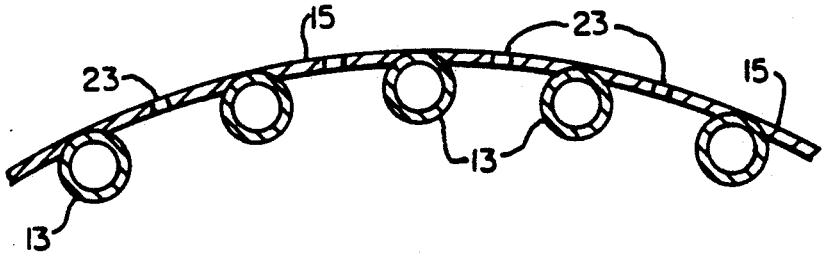
FIG. 8 is a partial sectional view of alternative web-tube attachment.

To provide a smoother surface and a better fit and seal between the baffles 18 the webs 15 may be disposed closer to the outer peripheral portion of the pipes 13, as shown in FIG. 8. The smoother peripheral surface also helps prevent jamming of waste 5 between the pipes 13 and the baffles 18.

Figure 3:
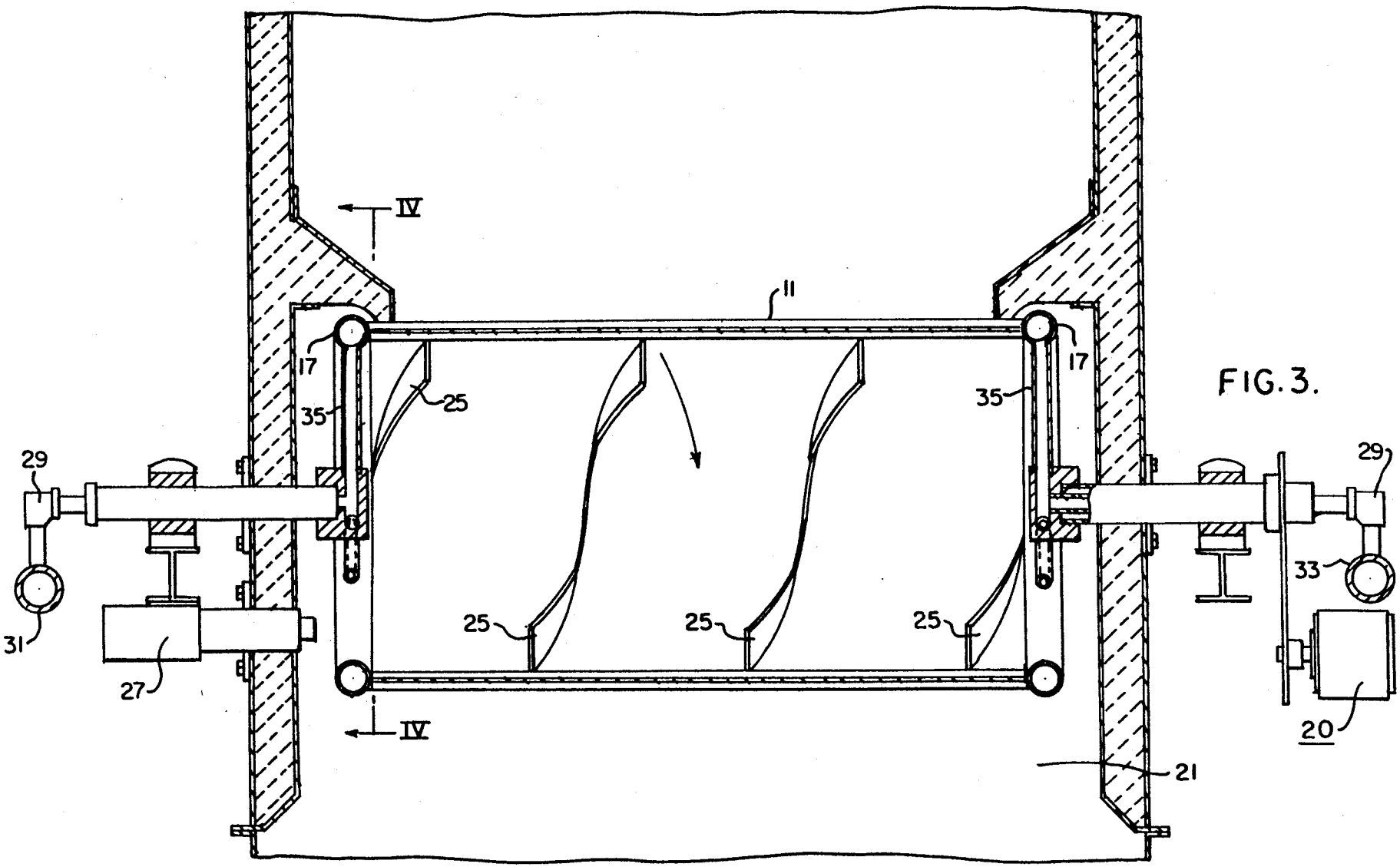
FIG. 3 is an enlarged partial sectional view of a roller grate with an auxiliary burner disposed adjacent thereto.

Each roller grate 13, as shown in FIG. 3, is rotated by its own drive system 20 so that the angular velocity of each roller grate 11 can be controlled to regulate the rate at which the burning waste 5 progresses down the undulating surface 19 from one roller grate 11 to the next lower roller grate 11.

A combustion air duct or plenum chamber 21 is disposed beneath each roller grate supplying combustion air through perforations 23 in the perforated web 15 to the waste being burned on the undulating surface 19.

A vane 25 is disposed on the inner surface of the roller grate 11 and spirals as it runs from one end of the roller grate 11 to the other. The spiral vane 25 moves particulate material which enters the roller grate through the perforations 23 to one end of the roller grate 11 where the particulate material is discharged into the plenum chamber 21 and can be removed form the lower end thereof.

An auxiliary burner 27 is also shown in FIG. 3 and is operated periodically in order to melt aluminum, which drips from the burning waste and solidifies on the internal surface of the roller grate 11.

Figure 4:
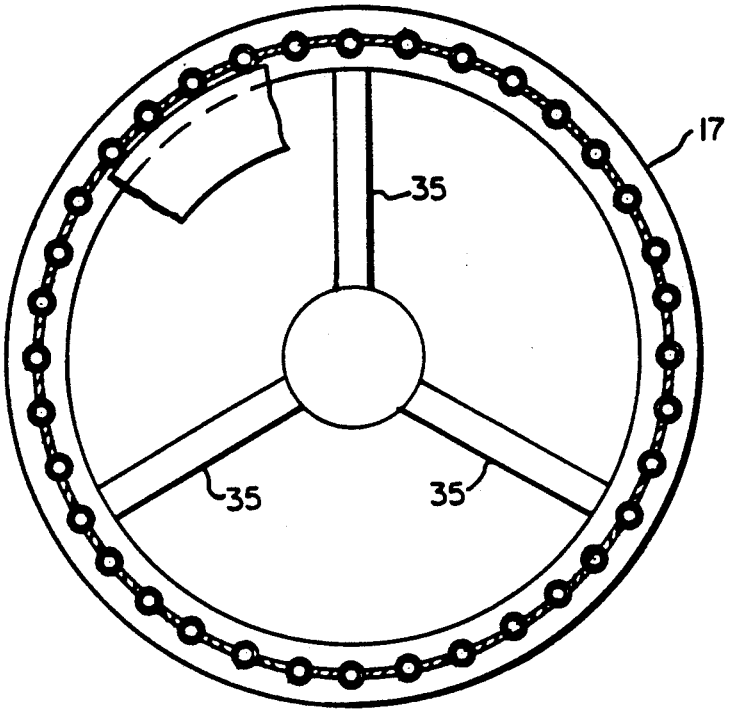
FIG. 4 is a sectional view taken on line IV—IV of FIG. 3.

The roller grate 11, shown in FIGS. 3 and 4, has a rotary joint 29 on each end connected respectively to a inlet header 31 and an outlet header 33. This arrangement allows cooling water to pass straight through the pipes 13. The ring headers 17 are connected in fluid communication with the rotary joints 29 by three tubular spokes 35.

Figure 5:
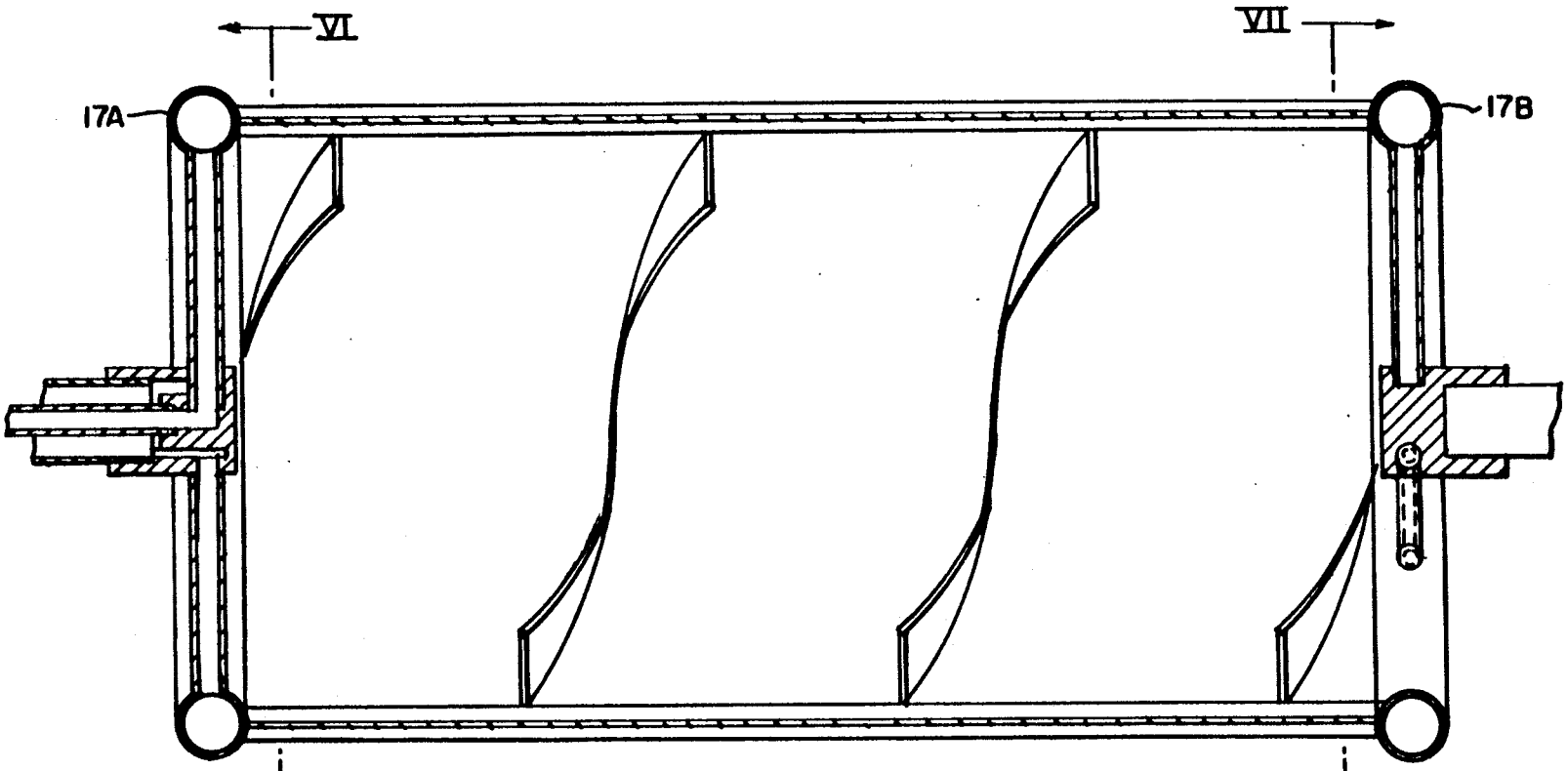
FIG. 5 is an enlarged partial sectional view of an alternative cooling water arrangement for the roller grates.
Figure 6:
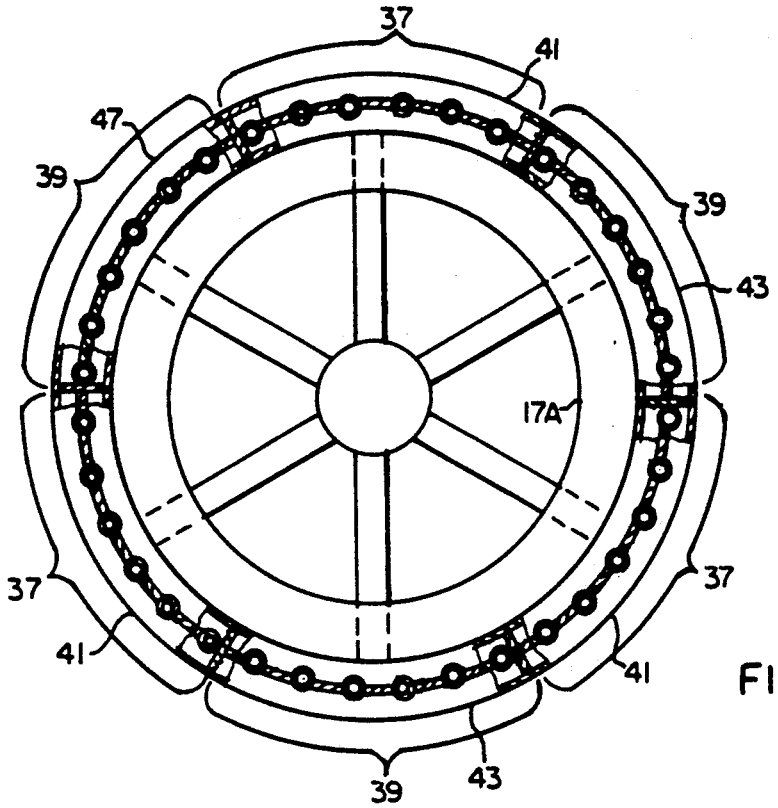
FIG. 6 is a sectional view taken on line VI—VI of FIG. 5.
Figure 7:
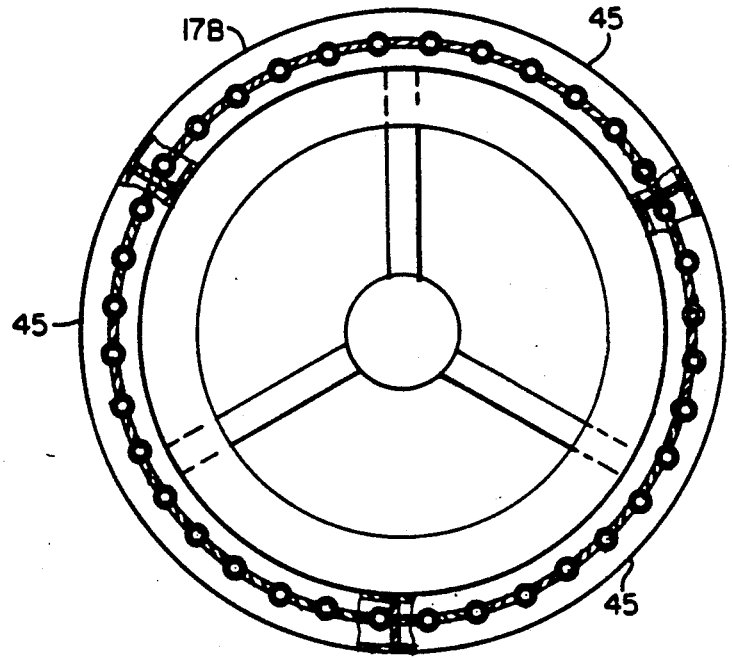
FIG. 7 is a sectional view taken on line VII—VII of FIG. 5.

As Shown in FIGS. 5, 6 and 7 cooling water can be supplied and returned via one end of the roller grate 11 and in that case the pipes 13 are disposed in banks of inlet pipes 37 and banks or return pipes 39. The ring header 17A is divided into 3 inlet compartments 41 and three return compartments 43, while the ring header 17B is divided into three return compartments 45, which are in fluid communication with both the inlet and outlet banks of pipes 37 and 39. In either case the cooling water can flow through the roller grates in parallel or in series or in both parallel and series depending on the heat transfer and pressure drop requirements.

The side walls 51 adjacent the roller grates 11 and the inclined wall 53 opposite the undulating surface 19 are covered with a refractory material and are disposed to direct the hot gases from the burning waste to a water wall flue 55 forming the lower portion of the boiler 3. The hot gases flow upwardly in flue 55 over a superheater portion 57 of the boiler 3 and through a economizer portion 59 of the boiler 3 fluidly connecting a steam drum 61 to a water drum 63. The hot gases then pass through a particulate material removal device 63 such as an electrostatic precipitator and out a smoke stack 65.

The roller grate incinerator 1 herein described advantageously is easily scaled up to provide large grate areas, are covered by the fuel bed and thus shielded from flame radiation and corrosive flue gases. The velocity of the roller grates 11 can be independently controlled allowing variations in resident time of the waste in each zone of the undulating surface 19. The water cooled tubes or pipes 13 utilized to form the roller grates 11 result in lower grate metal temperatures, prolonging the life of the roller grates 11.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A water cooled roller grate incinerator cooperatively associated with a boiler comprising a plurality of cylindrical shaped roller grates, each having a plurality of circular arrays of spaced apart cooling tubes separated by perforated webs and connected at each end to a ring header; a rotary joint associated with each cylindrical roller grate for supplying cooling fluid to the circular array of tubes to keep them cool and returning heated fluid to the boiler; each roller grate being disposed to rotate about a centrally disposed axis; the axes of the roller grates being disposed in an inclined plane generally parallel to each other so as to form an undulating surface; a waster hopper with a waste feed ram disposed on the lower end of the hopper for feeding waste to the undulating surface; a combustion air system for supplying combustion air through the perforated webs to the waste pushed on the undulating surface by the waste feed ram to burn the waste; a separate drive system for each grate, the drive system regulating the rate at which the burning waste progresses across the undulating surface portion of each grate as the grates rotate transferring the waste from one roller grate to the next lower roller grate as the waste burns.

2. The water cooled roller grate incinerator of claim 1, wherein the roller grates are all the same size and are interchangeable.

3. The water cooled roller grate incinerator of claim 1, further comprising an air duct for supplying air to each roller grate.

4. The water cooled roller grate incinerator of claim 1, further comprising an auxiliary burner disposed adjacent a plurality of said roller grates to periodically heat the interior of the associated roller grate to melt any aluminum accumulated therein.

5. The water cooled roller grate incinerator of claim 1, further comprise baffles between adjacent roller grates to assist in transferring the burning waste from one roller grate to the next lower roller grate.

6. The water cooled roller grate incinerator of claim 1, wherein the array of tubes forming the roller grate are arranged in banks of inlet tubes and banks of return tubes and inlet and return bank are so arranged that the water enters and leaves from the same end of the roller grate.

7. The water cooled roller grate incinerator of claim 1, wherein the cooling water enters one end of the roller grate and exits the other end thereof.

8. The water cooled roller grate incinerator of claim 1, wherein the roller grates have a vane spiraling on the inner surface from one end to the other to move particulate material, which enters the central portion of the roller grate to one end thereof where the particulate material is discharged from the roller grate.

9. The water cooled roller grate incinerator of claim 1, wherein the boiler has a flue lined with water wall tubes and said flue is disposed adjacent the waste inlet end of, the undulating surface.

10. The water cooled roller grate incinerator of claim 1, wherein the walls adjacent the sides of the roller grates and the wall opposite the roller grates are covered with refractory material and cooperate to direct the hot gases from the burning waste to the water wall flue portion of the boiler.

* * * * *